US007139008B2

(12) United States Patent
Mori et al.

(10) Patent No.: US 7,139,008 B2
(45) Date of Patent: Nov. 21, 2006

(54) DISPLAY METHOD AND DISPLAY APPARATUS

(75) Inventors: Yukio Mori, Osaka (JP); Shigeo Kinoshita, Gifu (JP)

(73) Assignee: Sanyo Electric Co., Ltd., Osaka (JP)

( * ) Notice: Subject to any disclaimer, the term of this patent is extended or adjusted under 35 U.S.C. 154(b) by 321 days.

(21) Appl. No.: 10/395,251

(22) Filed: Mar. 25, 2003

(65) Prior Publication Data

US 2003/0210256 A1 Nov. 13, 2003

(30) Foreign Application Priority Data

Mar. 25, 2002 (JP) ..... 2002-084200

(51) Int. Cl.
*G09G 5/10* (2006.01)
*G09G 3/30* (2006.01)

(52) U.S. Cl. ..... 345/690; 345/77

(58) Field of Classification Search ..... 345/690–693, 345/76–83; 315/169.3, 169.4; *G09G 3/30, G09G 3/32*

See application file for complete search history.

(56) References Cited

U.S. PATENT DOCUMENTS 6,025,818 A * 2/2000 Okano ..... 345/63
6,529,204 B1 * 3/2003 Mikoshiba et al. ..... 345/597
6,617,797 B1 * 9/2003 Higuchi et al. ..... 315/169.1
6,762,800 B1 * 7/2004 Nie et al. ..... 348/687
6,774,875 B1 * 8/2004 Tong et al. ..... 345/63
2002/0033783 A1 * 3/2002 Koyama ..... 345/82
2005/0041047 A1 * 2/2005 Miyata et al. ..... 345/690

FOREIGN PATENT DOCUMENTS

JP 11-194745 A 7/1999
JP 2001-013914 A 1/2001
JP 2001-228847 A 8/2001
JP 2001-331146 A 11/2001

OTHER PUBLICATIONS

Japanese Office Action for Corresponding Japanese Patent Application No. JP 2002-084200, Dispatched May 23, 2006.

* cited by examiner

*Primary Examiner*—Alexander Eisen
(74) *Attorney, Agent, or Firm*—McDermott Will & Emery LLP

(57) ABSTRACT

In a display apparatus, a luminance acquiring unit acquires luminance signals from inputted image signals. A difference calculating unit compares luminance signals of the current frame acquired by the luminance acquiring unit with those of a previous frame stored in a frame memory, and then takes a difference between these luminance signals. If the difference of the luminance is large, a judging unit judges that the image corresponding to a portion in question is moving. If the difference of the luminance is small, the judging unit judges that the image corresponding to the portion stays still. A gain calculating unit gradually lowers the luminance corresponding to a part where the image stays still, and gradually restores to the original level the luminance corresponding to a part where the image is moving.

15 Claims, 7 Drawing Sheets

$$Gain=(A*(1-dH/H)+B*dH/H)*(1-dV/V)+(C*(1-dH/H)+D*dH/H)*dV/V$$

DISPLAY METHOD AND DISPLAY APPARATUS

BACKGROUND OF THE INVENTION

1. Field of the Invention

The present invention relates to display apparatus and display method, and it particularly relates to a technique which reduces the unevenness and dispersion of luminance by smoothing a deterioration of respective optical elements in an active matrix display screen.

2. Description of the Related Art

Organic electroluminescent display apparatus (hereinafter referred to also as "organic EL apparatus" or "organic EL panel") is attracting much attention as new flat type display apparatus. In particular, active-matrix type organic EL display apparatus including thin film transistors (hereinafter referred to also as "TFT") as switching elements is the most promising candidate for the next generation display apparatus to replace the currently widely prevailing liquid crystal display (LCD) apparatus, and is a subject of intensive research and development activities competing for putting it to practical use.

Unlike the liquid crystal display elements, the organic EL elements themselves emit light. Thus, the backlight which is an indispensable structure in the liquid crystal display apparatus is no longer required, so that it is expected that the apparatus will be made further thinner and lighter. Utilizing the property of self-luminance, it is expected that the organic EL elements will be used as light emitting devices such as backlight of LCD apparatus.

It is a well-known fact that the organic EL elements deteriorate with luminescence and the luminance thereof drops gradually. When the same image is displayed for many hours in the same region, the deterioration in the organic EL element having high-luminance pixels deteriorates faster than that having low-luminance pixels, in accordance with luminance distribution of an image in question. As a result, even during the time when the image is not displayed at all, the dispersion or the irregularity of luminance corresponding to this image is visibly observed. Namely, the so-called screen burn-in phenomenon occurs. Even if the respective organic EL elements have enough life duration, the difficulties are encountered in their usage if the burn-in occurs in the panels. Thus, in order to provide long-life organic EL panels with high display quality, it is of course important to develop organic luminescent material resistant to deterioration, but it is also extremely important to develop a technology that suppresses the occurrence of luminance disparity and screen burn-in phenomenon.

SUMMARY OF THE INVENTION

The present invention has been made in view of the foregoing circumstances and an object thereof is to provide a technique by which to reduce the occurrence of the variation of luminance and screen burn-in phenomenon in display apparatus.

A preferred embodiment according to the present invention relates to a display apparatus. This display apparatus comprises: a luminance acquiring unit which acquires luminance of an image to be displayed; a storage which stores the luminance; a difference calculating unit which calculates a variation of the luminance by comparing the luminance of the image to be displayed and the luminance stored already in the storage; and a determining unit which determines an adjustment amount of luminance for the image to be displayed, based on the variation of the luminance calculated by the difference calculating unit.

When displaying images with motion, integrated values of the display luminance are almost equalized over a long period of time, so that the disparity of luminance is unlikely to occur. However, in a case when a still image is fixedly displayed for many hours, there is a concern that disparity might be caused in the degradation rate of display elements according to the luminance distribution of said still image. Thus, whether the image displayed is one with motion or one fixedly displayed is judged from the variation of the luminance, and the luminance is adjusted based on the judged results. Thereby, the disparity of luminance and the burn-in of an image can be reduced.

The luminance acquiring unit may acquire the luminance for each of pixels, the storage may store the luminance for each of the pixels, the difference calculating unit may calculate the variation for each of the pixels, and the determining unit may determine the adjustment amount for each of the pixels. Highly accurate luminance adjustment can be realized by adjusting the luminance for each of the pixels.

Moreover, the luminance acquiring unit may acquire the luminance for each of pixels, the storage may store the luminance for each of the pixels, the difference calculating unit may calculate the variation for each of the pixels, and the determining unit may measure the number of pixel whose variation is greater than a predetermined threshold value for each of regions having a predetermined size, and may determine the adjustment amount of luminance for the regions based on the number measured. The luminance acquiring unit may acquire the luminance for each of pixels, the storage may store an average value of the luminance for each of regions having a predetermined size, and the difference calculating unit may calculate a variation of the average value of the luminance for each of the regions, and the determining unit may determine the adjustment amount of luminance for each of the regions based on the variation of the average value of the luminance. The advantageous effects in which the minimally required memory size is reduced and the processing time is shortened can be expected by performing the luminance adjustment processing for each of the regions.

Moreover, the determining unit may classify the variation into a plurality of levels, and may determine the adjustment amount in accordance with the level. When the variation is less than a predetermined threshold value, the determining unit may determine the variation amount in such a manner as to lower the luminance. When the variation is small, it is highly probable that the image is fixedly displayed, so that the screen burn-in may be reduced by lowering the luminance. When the luminance is lower than a predetermined threshold value, the determining unit may not adjust the luminance. If the luminance is primarily low, this contributes minimally to the degradation of display elements, so that the images may be displayed as they are, in consideration of the visibility thereof, without making any adjustment of luminance. The determining unit may determine the adjustment amount in a manner such that the luminance is varied gradually. The undesirable drastic change in the luminance can be suppressed so as to reduce unnatural flow of images, by gradually adjusting the luminance.

Another preferred embodiment according to the present invention relates to a display method. This method includes: acquiring, for each of pixels, luminance of an image to be displayed; calculating a variation of the luminance for each of the pixels by comparing the luminance of the image to be displayed and the luminance of a previously displayed image; and adjusting the luminance of the image to be displayed, based on the variation of the luminance.

It is to be noted that any arbitrary combination of the above-described structural components and expressions changed between a method, an apparatus, a system and so forth are all effective as and encompassed by the present embodiments.

Moreover, this summary of the invention does not necessarily describe all necessary features so that the invention may also be sub-combination of these described features.

DETAILED DESCRIPTION OF THE INVENTION

The invention will now be described based on preferred embodiments which do not intend to limit the scope of the present invention but exemplify the invention. All of the features and the combinations thereof described in the embodiments are not necessarily essential to the invention.

First Embodiment

In a first embodiment, the rates of degradation of display elements that constitute each pixel are smoothened over the whole of a screen and the dispersion in display luminance thereon is thus reduced. This is realized by making an adjustment, when images are displayed on a display apparatus, by gradually lowering the luminance in a portion where a still picture is displayed fixedly and by gradually restoring the luminance in a part where moving images are displayed.

Figure 1:
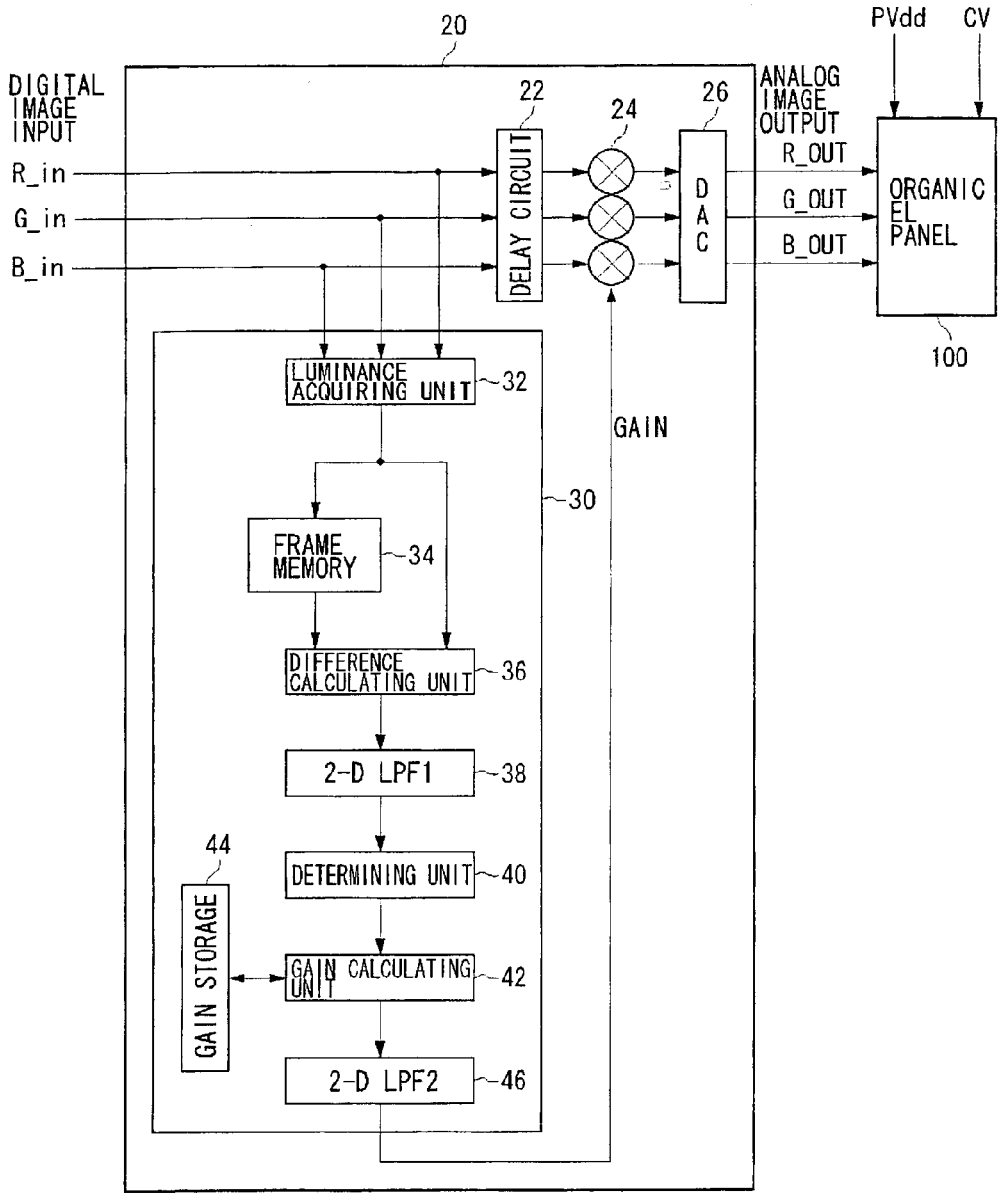
FIG. 1 shows an internal structure of a display apparatus according to a first embodiment.

FIG. 1 shows an internal structure of a display apparatus according to the first embodiment. A display apparatus 10 is mainly comprised of a display control unit 20 and an organic EL panel 100 as an example of a display unit. The display unit used in the present embodiment is the organic EL panel 100, but the display unit may be an inorganic EL panel, a liquid crystal panel, a cathode ray tube (CRT), a plasma display panel (PDP), a field emission display (FED) or the like.

The display control unit 20 is comprised of a luminance control unit 30 which adjusts the luminance of inputted image signals, a delay circuit 22 which delays an image signal during the operation by the luminance control unit 30, a multiplier 24 which multiplies the image signal by a gain outputted by the luminance control unit 30, and a D-A converter (DAC) 26 which converts digital image signals to analog image signals.

The luminance control unit 30 includes a luminance acquiring unit 32, a frame memory 34, a difference calculating unit 36, a first two-dimensional low-pass filter (2-D LPF1) 38, a determining unit 40, a gain calculating unit 42, a gain storage 44 and a second two-dimensional low-pass filter 46 (2-D LPF2). In terms of hardware, this structure can be realized by a CPU, a memory and other LSIs of an arbitrary computer. In terms of software, it is realized by memory-loaded programs or the like having a function of controlling the luminance, but drawn and described here are functional blocks that are realized in cooperation with those. Thus, it is understood by the skilled in the art that these functional blocks can be realized in a variety of forms by hardware only, software only or the combination thereof.

The luminance acquiring unit 32 acquires a luminance signal based on inputted image signals. In the case of FIG. 1, signals for R, G and B, respectively, are inputted as image signals, so that a luminance signal Y is computed using a calculation formula, such as $Y=0.299\times R+0.587\times G+0.144\times B$. Where luminance signal Y and color-difference signals Cr and Cb are inputted as image signals, the luminance signal Y may be utilized as it is.

The luminance signal Y calculated for each pixel is supplied to the difference calculating unit 36 and, at the same time, stored in the frame memory 34. The frame memory 34, which may be an FIFO (First In First Out) memory, is provided to delay the luminance signal Y as much as one frame. The difference calculating unit 36 calculates the difference, or the time variation, between the luminance signal for a current frame supplied from the luminance acquiring unit 32 and the luminance signal for a previous frame, that is a frame immediately prior to the current frame, stored in the frame memory 34, for each pixel. The first two-dimensional low-pass filter 38 performs a low-pass filtering processing of, for instance, a tap coefficient (1, 2, 1) in the horizontal direction and a tap coefficient (1, 2, 1) in the vertical direction on the difference value for one frame obtained by the difference calculating unit 36 and removes the high-frequency component. This removes peculiar difference value or values attributable to errors in image signals or malfunctions of the luminance acquiring unit 32 or the difference calculating unit 36, so that the difference value is smoothed up two-dimensionally.

The determining unit 40 makes a decision on motion for each pixel, based on the difference in a luminance signal for each pixel. According to the present embodiment, when the time variation of a luminance signal is greater than a predetermined threshold value, the pixel is judged as a "moving" pixel, and when it is less than the predetermined threshold value, the pixel is judged as a "still" pixel. Although what is actually dealt with here is the magnitude of variation of luminance signals, the following description will be made easier to understand by referring to a pixel with large variation of luminance signal as a "moving" pixel and one with small variation of luminance signal as a "still" pixel. As a matter of fact, the region where there are more pixels with large variation of luminance signals is most likely a moving image, whereas the region where there are more pixels with small variation of luminance signals is most likely a still image. Therefore, the "moving" and "still" of pixels as used here are usually in agreement with the movement or stillness of actual images. According to the method of this embodiment, however, when, for instance, a moving image has a region where the display of the same image continues as the background, the pixels in that region are judged as "still," so that luminance can be controlled with higher accuracy than the method whose control is based on the judgment of a whole image as moving or still. In the description of the present embodiment, the pixels are classified into "moving" and "still" for the sake of simplicity, but it goes without saying that a plurality of threshold values may be set and the pixels may be classified into a plurality of levels of motion.

The gain calculating unit 42 calculates a gain to be used for luminance adjustment, for each pixel, stores the calculated gain in the gain storage 44 and at the same time outputs the calculated gain to the second two-dimensional low-pass filter 46. The gain, which is a value by which to multiply an inputted image signal in order to adjust the luminance thereof, takes a value not smaller than a predetermined positive lower limit value and not larger than 1. When the gain is 1, the inputted image signal is outputted to the display unit 100 as it is. With a smaller gain, an image signal with lower luminance than the inputted image signal is outputted to the display unit 100. The gain calculating unit 42 reads out the gain of a frame, which is one immediately prior to the current frame, stored in the gain storage 44, and, for a pixel which is judged as "still" by the determining unit 40, subtracts a predetermined value from the gain to lower the luminance of the pixel, or, for a pixel judged as "moving," adds a predetermined value to the gain to restore the darkened luminance to the original luminance of the pixel. In the region where moving images are being displayed, the screen burn-in is less likely to occur because the average display luminance of the pixels becomes nearly equal in a long time. In the region where the same image is displayed statically, however, the screen burn-in is likely to occur because degradation progresses in the pattern of the image. Hence, the burn-in is lightened by gradually lowering the luminance of the pixel which is judged as "still." When the gain is 1, no more of a predetermined value is added even when the judgment of "moving" is repeated, and when the gain is at the predetermined lower limit, no more of a predetermined value is subtracted even when the judgment of "still" is repeated.

The lower limit value of gain may be fixed at a certain value or may be changed according to the luminance distribution of an image, or the like. For example, where the average luminance of an image is high, the lower limit value may be set low so as to allow for a sufficient lowering of luminance, but where the average luminance of an image is low, the lower limit value may be set high so as to prevent an excessive darkening of the image. Moreover, the value to be added to or subtracted from the gain may be fixed at a certain value or may be changed according to the luminance distribution of an image, or the like.

The second two-dimensional low-pass filter 46 removes high-frequency components in the horizontal and vertical directions from the gain for a single frame obtained by the gain calculating unit 42. This prevents the visibility of an image from dropping due to a great difference in gain from adjacent pixels. The result of operation by the second two-dimensional low-pass filter (2-D LPF2) 46 is outputted to the multiplier 24, where each of the image signals of the present frame having been delayed by the delay circuit 22 is multiplied by the calculated results of the 2-D LPF2 46. The results of the multiplication are converted into analog signals by the D-A converter 26 and outputted to the display unit 100.

Figure 2:
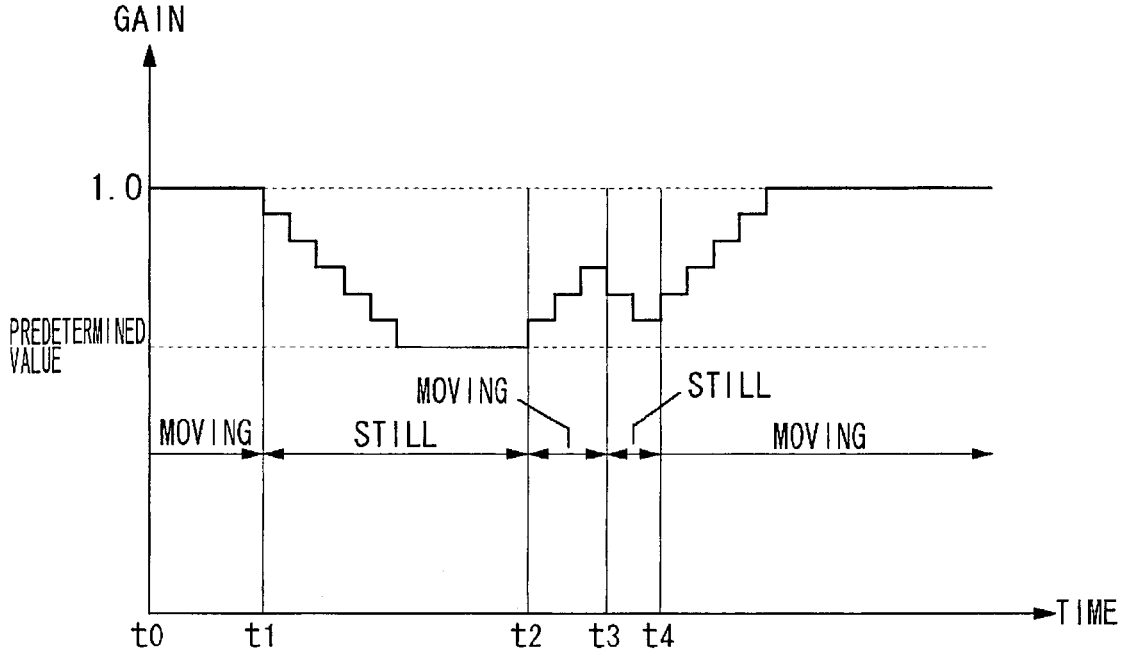
FIG. 2 shows an example of change with time of the gain of a certain pixel calculated by a gain calculating unit.

FIG. 2 shows an example of change with time of the gain of a certain pixel calculated by the gain calculating unit 42. The gain, which is 1 at time t0, begins dropping in steps of predetermined values at time t1, when the pixel switches from "moving" to "still," and when the gain reaches the predetermined lower limit value, it is kept at the lower limit value thereafter. At time t2, when the pixel switches from "still" to "moving", the gain begins rising in steps of predetermined values, but at time t3, when the pixel switches from "moving" to "still", the gain begins dropping again in steps of predetermined values. At time t4, when the pixel switches from "still" to "moving", the gain again begins rising in steps of predetermined values, and when the gain reaches 1, the gain is maintained at 1 thereafter. In this manner, at the switching from "moving" to "still" or vice versa, the gain is not jumped from 1 to the lower limit value or vice versa. Instead, the gain is changed in steps of predetermined values, thus making the change of luminance less conspicuous and retaining a degree of naturalness.

When the luminance of inputted image signal changes in the neighborhood of a threshold value used in the judgment by the determining unit 40, the judgment changes from "moving" to "still", or from "still" to "moving" whenever the threshold value is crossed. As a result, brightening and darkening are frequently repeated by the luminance control in an unnatural manner despite the fact that the luminance is nearly constant. To avoid this kind of unnatural phenomenon, two kinds of threshold values, namely, a first threshold value for a change from "moving" to "still" and a second threshold value for a change from "still" to "moving" may be prepared for use by the determining unit 40, and they may be given a hysteresis by making the first threshold value smaller than the second threshold value. Thereby, the luminance can be controlled in a more natural manner.

Figure 3:
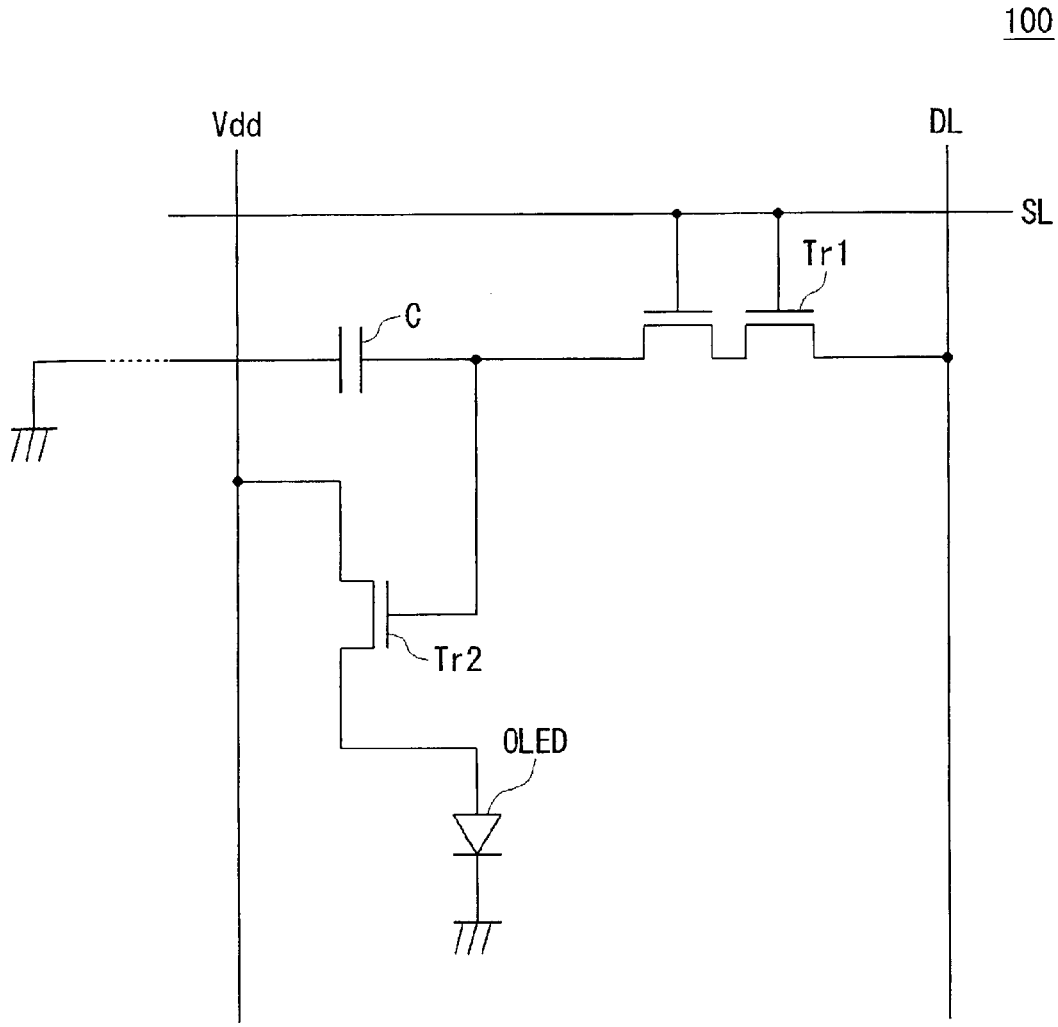
FIG. 3 shows a circuit structure of a single pixel of a display unit.

FIG. 3 shows a circuit structure of a pixel of a display unit 100. This circuit is comprised of an organic light-emitting diode OLED, two transistors Tr1 and Tr2 for controlling the organic light-emitting diode OLED, a capacitor C, a scanning line SL for sending scanning signals, a data line DL for sending luminance data, and a power supply line Vdd for supplying electric current to the organic light-emitting diode OLED.

The power supply line Vdd supplies electric current that causes the organic light-emitting diode OLED to emit light. The data line DL sends signals of luminance data to control the luminance of each organic light-emitting diode OLED, outputted from a display control unit 20. The scanning line SL sends scanning signals to control the timing of light emission by each organic light emitting diode OLED.

A gate electrode of a first transistor (hereinafter referred to also as "switching transistor") Tr1 is connected to a scanning line SL, a drain electrode (or a source electrode) of the first transistor Tr1 is connected to a data line DL, and the source electrode (or the drain electrode) of the first transistor Tr1 is connected to a gate electrode of a second transistor (hereinafter referred to also as "driving transistor") Tr2. In this embodiment, the switching transistor is of a double gate structure with two gate electrodes. In other modes, however, the switching transistor may be of a single gate structure or a multi-gate structure with three or more gate electrodes. Moreover, the switching transistor Tr1 may be either an n-channel transistor or a p-channel transistor.

A source electrode (or a drain electrode) of the driving transistor Tr2 is connected to an anode of the organic light-emitting diode OLED, and the drain electrode (or the source electrode) of the driving transistor Tr2 is connected to a power supply line Vdd. As with the switching transistor Tr1, the driving transistor Tr2 may be of a single gate structure or a multi-gate structure. Moreover, the driving transistor Tr2 may be either an n-channel transistor or a p-channel transistor.

The anode of the organic light-emitting diode OLED is connected to the source electrode (or the drain electrode) of the driving transistor Tr2, and a cathode of the organic light-emitting diode OLED is grounded. One end of the capacitor C is connected to the drain electrode (or the source electrode) of the switching transistor Tr1 and the gate electrode of the driving transistor Tr2, while the other end of the capacitor C is connected to a wiring not shown and grounded. The other end of the capacitor C may be connected to the power supply line Vdd.

Now, an operation by the above structure is described hereinbelow. When a scanning signal in the scanning line SL is brought high to write luminance data to the organic light-emitting diode OLED, the switching transistor Tr1 turns on and the luminance data inputted to the data line DL is set in both the driving transistor Tr2 and the capacitor C. Then a current corresponding to the luminance data flows between the source and the drain of the driving transistor Tr2, and as this current flows to the organic light-emitting diode OLED, the organic light-emitting diode OLED emits light. And when a scanning signal in the scanning line SL is brought low, the switching transistor Tr1 turns off, but, the gate voltage of the driving transistor Tr2 is maintained, so that the organic light-emitting diode OLED continues emitting light according to the set luminance data.

At the next timing of scanning, as a scanning signal in the scanning line SL is again brought high, the switching transistor Tr1 turns on and new luminance data inputted to the data line DL is set in the driving transistor Tr2 and the capacitor C. As a result, the organic light-emitting diode OLED emits light according to the new luminance data.

Second Embodiment

According to a second embodiment, the luminance adjustment is not made on pixels corresponding to the inputted signals whose luminance is low whereas the luminance adjustment is made on only pixels whose luminance is high in the display apparatus described in the first embodiment. Namely, only high-luminance data which has increased effect on the screen burn-in phenomenon are subject to the luminance adjustment, so that the luminance adjustment is made in more natural effective ways. As a result thereof, the unevenness and dispersion of luminance as well as the occurrence of burn-in phenomenon can be reduced.

Figure 4:
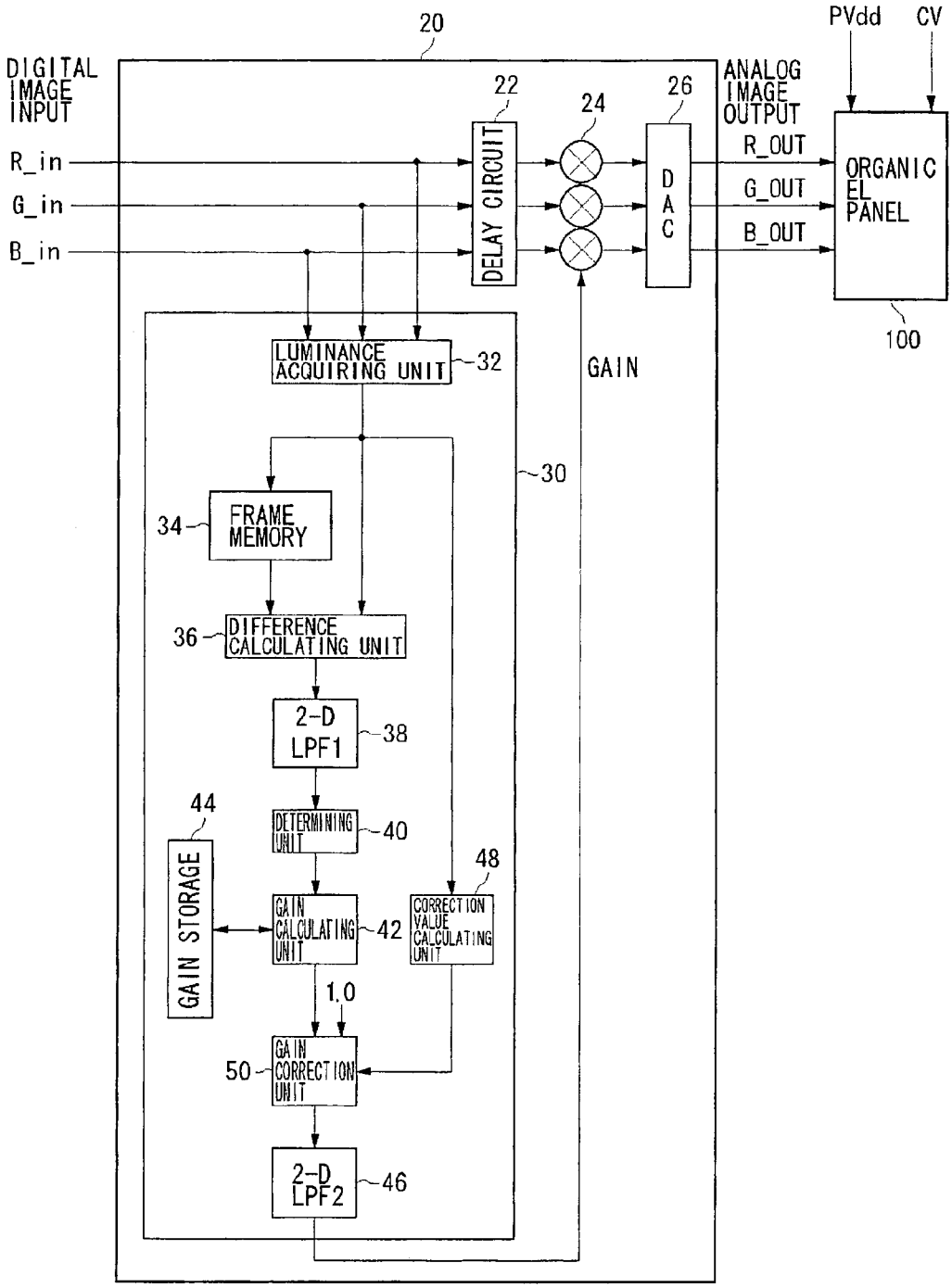
FIG. 4 shows an internal structure of a display apparatus according to a second embodiment.

FIG. 4 shows an internal structure of a display apparatus according to the second embodiment. The display apparatus according to this second embodiment, in addition to the structural components described in the first embodiment, includes a correction value calculating unit 48 and a gain correction unit 50. The same structural components as shown in FIG. 1 are given the same reference numerals. Hereinafter, a structure differing from that in the first embodiment will be mainly described.

Figure 5:
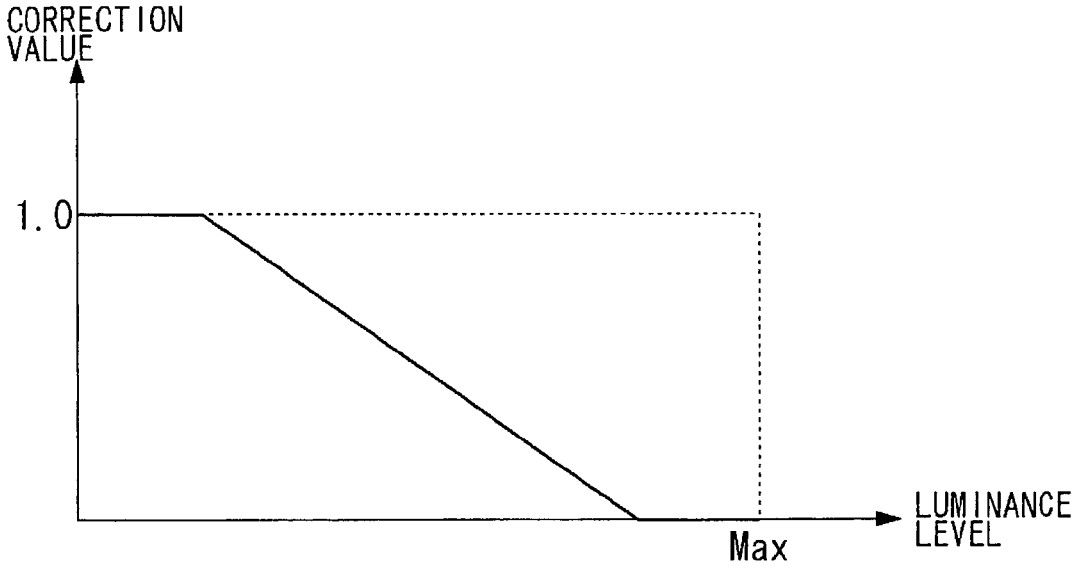
FIG. 5 shows an example of correction values calculated by a correction value calculating unit.

The correction value calculating unit 48 calculates a correction value for appropriately correcting the gain based on the level of luminance. FIG. 5 shows an example of the correction values calculated by the correction value calculating unit 48. According to the second embodiment, the correction value for a pixel whose luminance is low becomes 1, and the correction value approaches 0 as the luminance becomes high whereas the correction value for a pixel whose luminance is high eventually becomes 0.

The gain correction unit 50 makes a correction on a gain calculated by the gain calculating unit 42 (hereinafter referred to also as "calculated gain"), using a correction value calculated by the correction value calculating unit 48. In the second embodiment, the correction is made by the following formula.

$$(\text{Gain correction value})=1.0\times(\text{Correction value})+(\text{Calculated gain})\times(1-(\text{Correction value}))$$

According to the above formula, when the luminance is very low, that is, when the correction value becomes 1 in FIG. 5, (Gain correction value)=1. On the other hand, when the luminance is very high, that is, when the correction value becomes 0 in FIG. 5, (Gain correction value)=(Calculated gain). If the correction value takes values between 0 and 1, inclusive, the gain correction value takes values between the calculated gain and 1, inclusive.

In this manner, when the luminance of a pixel is high, the calculated gain is used as it is. On the other hand, when the luminance of the pixel is low, an adjustment amount of the luminance is reduced by adjusting the calculated gain in the upper value thereof whereas, when the luminance of the pixel is very low, no adjustment is made regardless of the value of a calculated gain. Thereby, the luminance adjustment is effectively made on the high-luminance data most attributable to the dispersion of the luminance whereas the luminance adjustment is suppressed to minimum on the low-luminance data least attributable to the dispersion of luminance, so that images can be displayed in more natural manners taking the visibility into serious consideration.

Third Embodiment

According to a third embodiment, a gain is calculated for each region constituted by a plurality of pixels. The luminance control is performed for each region of a predetermined size, so that the necessary memory size, that is, the minimally required memory amount is reduced and the processing time can be shortened.

Figure 6:
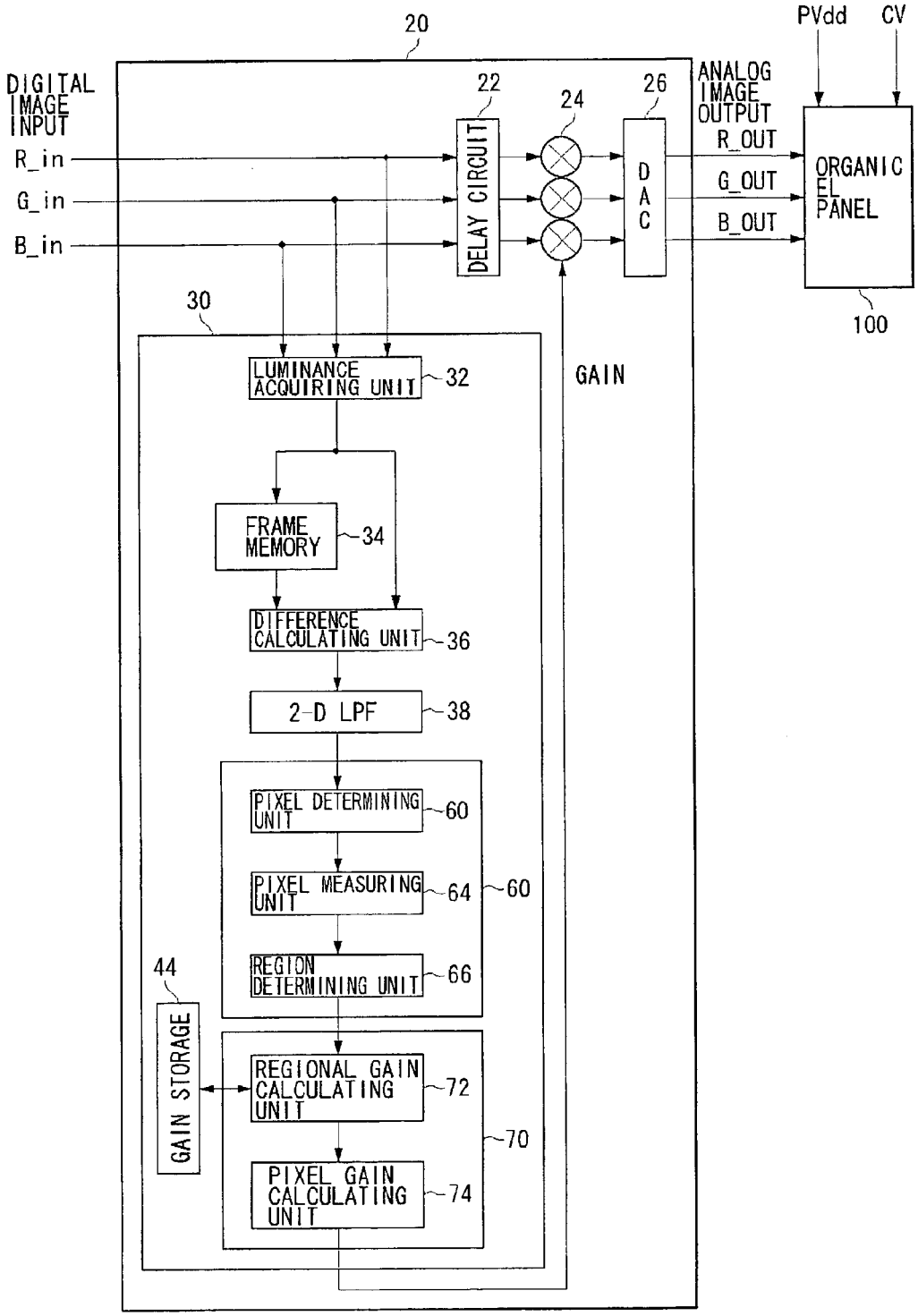
FIG. 6 shows an internal structure of a display apparatus according to a third embodiment.

FIG. 6 shows an internal structure of a display apparatus according to a third embodiment. The display apparatus according to this third embodiment is structured in a manner such that a determining unit 60 is provided in place of the determining unit 40 in the first embodiment and a gain calculating unit 70 is provided in place of the gain calculating unit 42 in the first embodiment, and the second two-dimensional low-pass filter 64 in the first embodiment is no longer provided. The other structural components which are the same as those shown in the first embodiment shown in FIG. 1 are given the same reference numerals. Hereinafter, a structure differing from that in the first embodiment will be mainly described.

The determining unit 60 includes a pixel determining unit 62, a pixel measuring unit 64 and a region determining unit 66. Similar to the determining unit 40 in the first embodiment, the determining unit 62 makes a decision on motion for each pixel, based on the difference in luminance signal for each pixel. According to this third embodiment, too, when the time variation of a luminance signal is less than a predetermined threshold value, the pixel is judged as a "still" pixel, and when it is greater than the predetermined threshold value, the pixel is judged as a "moving" pixel. The pixel measuring unit 64 measures the number of "still" and "moving" pixels within a region of a predetermined size. When the number of "still" pixels measured by the pixel measuring unit 64 is greater than a predetermined threshold value, the region determining unit 66 judges the region as "still." When the number of "still" pixels measured by the pixel measuring unit 64 is less than the predetermined threshold value, the region determining unit 66 judges the region as "moving."

The gain calculating unit 70 includes a regional gain calculating unit 72 and a pixel gain calculating unit 74. The regional gain calculating unit 72 performs, for each region, the processing similar to that of the gain calculating unit 42 in the first embodiment. The regional gain calculating unit 72 reads out the gain of a frame, which is one immediately prior to the current frame, stored in the gain storage 44, and, for a region which is judged as "still" by the region determining unit 66, subtracts a predetermined value from the gain to lower the luminance of the region, or, for a region judged as "moving," adds a predetermined value to the gain to restore the darkened luminance to the original luminance of the region. The thus calculated gain is stored in the gain storage 44. According to this method, the gain storage 44 stores the gains for each region, so that the necessary memory size can be reduced.

Figure 7:
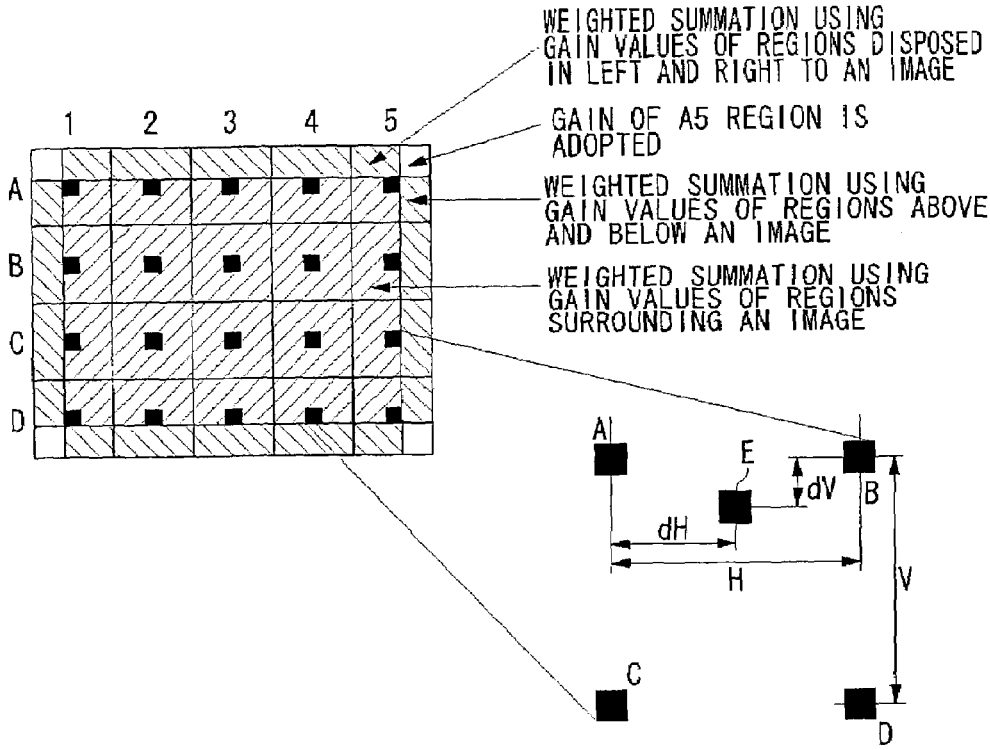
FIG. 7 shows how a gain value of each pixel is calculated by a pixel gain calculating unit.

The pixel gain calculating unit 74 calculates the gain of each pixel, based on the gain calculated by the regional gain calculating unit 72. The gain value of a region in question may be adopted as the gain value of each pixel in that region. However, since there is a concern that a block noise might be caused then, it is desirable that the following calculation method be employed. FIG. 7 shows an example where the gain value of each pixel is calculated by weighted-summing the gain value of the region. Suppose that the gain value of the region is the gain value of a pixel positioned in the center of the region and that the other pixels are interpolated by using the gain values of region surrounding them. For instance, the gain value of a pixel E is calculated according to the following equation.

$$(\text{Gain value of } E)=(A\times(1-dH/H)+B\times dH/H)\times(1-dV/V)+(C\times(1-dH/H)+D\times dH/H)\times dV/V$$

As for pixels in the vicinity of four sides of an image, the weighted summation is carried out using gain values of regions disposed in the left and right to the image or above and below the image and, as for pixels in four corners of the image, the gain values of the regions to which the pixel belongs are adopted. Thereby, the gain value for each pixel can be properly set.

Outputs from the pixel gain calculating unit 74 are supplied to the multiplier 24 as they are. In this third embodiment, the gain value for each pixel is calculated by interpolation using the gain values of the regions. Thus, the gain values of the pixels are primarily distributed in a smooth manner, so that there is no need of removing high-frequency components using the two-dimensional low-pass filter.

The present invention has been described based on the embodiments which are only exemplary. It is understood by those skilled in the art that there exist other various modifications to the combination of each component and process described above and that such modifications are encompassed by the scope of the present invention.

In the present embodiments, the luminance control is done frame by frame. However, the decision on motion may be done only once in a few frames and the then calculated gain may be utilized continuously until a next decision on motion.

Though the luminance control is performed pixel by pixel in the first embodiment, the similar processing may be performed for each region of a predetermined size. Namely, an average luminance is acquired, for each region, by the luminance acquiring unit 32, and the acquired average luminance is stored in the frame memory 34. Then, a variation of the average luminance is calculated, for each region, by the difference calculating unit 36. Thereafter, the decision on motion is made on each region by the determining unit 40, and the gain for each region is obtained by the gain calculating unit 42. At this time, the gain may be calculated, for each pixel, by the pixel gain calculating unit 74 according to the third embodiment, so as to perform the luminance control thereon. By employing this method, the minimally required memory size for the frame memory can be reduced.

Although the present invention has been described by way of exemplary embodiments, it should be understood that many changes and substitutions may further be made by those skilled in the art without departing from the scope of the present invention which is defined by the appended claims.

What is claimed is:

1. A display apparatus, comprising:

a luminance acquiring unit which acquires luminance of an image to be displayed;

a storage which stores the luminance;

a difference calculating unit which calculates a variation of the luminance by comparing the luminance of the image to be displayed and the luminance stored already in said storage; and a determining unit which determines an adjustment amount of luminance for the image to be displayed, based on the variation of the luminance calculated by said difference calculating unit, wherein said luminance acquiring unit acquires the luminance for each of pixels, said storage stores the luminance for each of the pixels, said difference calculating unit calculates the variation for each of the pixels, and said determining unit measures the number of pixel whose variation is greater than a predetermined threshold value for each of regions having a predetermined size, and determines the adjustment amount of luminance for the regions based on the number measured.

2. A display apparatus according to claim 1, wherein said determining unit classifies the variation into a plurality of levels, and determines the adjustment amount in accordance with the level.

3. A display apparatus according to claim 1, wherein, when the variation is less than a predetermined threshold value, said determining unit determines the variation amount in such a manner as to lower the luminance.

4. A display apparatus according to claim 1, wherein, when the luminance of the image to be displayed is lower than a predetermined threshold value, said determining unit does not adjust the luminance of the image to be displayed.

5. A display apparatus according to claim 1, wherein said determining unit determines the adjustment amount in a manner such that the luminance is varied gradually.

6. A display apparatus, comprising:

a luminance acquiring unit which acquires luminance of an image to be displayed;

a storage which stores the luminance;

a difference calculating unit which calculates a variation of the luminance by comparing the luminance of the image to be displayed and the luminance stored already in said storage; and a determining unit which determines an adjustment amount of luminance for the image to be displayed, based on the variation of the luminance calculated by said difference calculating unit, wherein said luminance acquiring unit acquires the luminance for each of pixels, said storage stores an average value of the luminance for each of regions having a predetermined size, and said difference calculating unit calculates a variation of the average value of the luminance for each of the regions, and said determining unit determines the adjustment amount of luminance for each of the regions based on the variation of the average value of the luminance.

7. A display apparatus according to claim 6, wherein said determining unit classifies the variation into a plurality of levels, and determines the adjustment amount in accordance with the level.

8. A display apparatus according to claim 6, wherein, when the variation is less than a predetermined threshold value, said determining unit determines the variation amount in such a manner as to lower the luminance.

9. A display apparatus according to claim 6, wherein, when the luminance of the image to be displayed is lower than a predetermined threshold value, said determining unit does not adjust the luminance of the image to be displayed.

10. A display apparatus, comprising:

a luminance acquiring unit which acquires luminance of an image to be displayed;

a storage which stores the luminance;

a difference calculating unit which calculates a variation of the luminance by comparing the luminance of the image to be displayed and the luminance stored already in said storage; and a determining unit which determines an adjustment amount of luminance for the image to be displayed, based on the variation of the luminance calculated by said difference calculating unit, wherein, when the variation is less than a predetermined threshold value, said determining unit determines the variation amount in such a manner as to lower the luminance.

11. A display apparatus according to claim 10, wherein said luminance acquiring unit acquires the luminance for each of the pixels, said storage stores the luminance for each of the pixels, said difference calculating unit calculates the variation for each of the pixels, and said determining unit determines the adjustment amount for each of the pixels.

12. A display apparatus, comprising:

a luminance acquiring unit which acquires luminance of an image to be displayed;

a storage which stores the luminance;

a difference calculating unit which calculates a variation of the luminance by comparing the luminance of the image to be displayed and the luminance stored already in said storage; and a determining unit which determines an adjustment amount of luminance for the image to be displayed, based on the variation of the luminance calculated by said difference calculating unit, wherein, when the luminance of the image to be displayed is lower than a predetermined threshold value, said determining unit does not adjust the luminance of the image to be displayed.

13. A display apparatus according to claim 12, wherein said luminance acquiring unit acquires the luminance for each of the pixels, said storage stores the luminance for each of the pixels, said difference calculating unit calculates the variation for each of the pixels, and said determining unit determines the adjustment amount for each of the pixels.

14. A display method, including:

acquiring, for each of pixels, luminance of an image to be displayed;

calculating a variation of the luminance for each of the pixels by comparing the luminance of the image to be displayed and the luminance of a previously displayed image; and adjusting the luminance of the image to be displayed, based on the variation of the luminance, wherein, when the variation is less than a predetermined threshold value, said determining unit determines the variation amount in such a manner as to lower the luminance.

15. A display method, including:

acquiring luminance of an image to be displayed;

calculating a variation of the luminance by comparing the luminance of the image to be displayed and luminance stored already in a storage that stores the luminance; and determining an adjustment amount of luminance for the image to be displayed, based on the variation of the luminance, wherein, when the variation is less than a predetermined threshold value, said determining unit determines the variation amount in such a manner as to lower the luminance.

* * * * *